US011067282B2

(12) United States Patent
Kim

(10) Patent No.: US 11,067,282 B2
(45) Date of Patent: Jul. 20, 2021

(54) CROSSFIRE TUBE, COMBUSTOR INCLUDING THE SAME, AND GAS TURBINE INCLUDING THE SAME

(71) Applicant: DOOSAN HEAVY INDUSTRIES & CONSTRUCTION CO., LTD., Changwon-si (KR)

(72) Inventor: Eun Young Kim, Seoul (KR)

( * ) Notice: Subject to any disclaimer, the term of this patent is extended or adjusted under 35 U.S.C. 154(b) by 90 days.

(21) Appl. No.: 16/521,546

(22) Filed: Jul. 24, 2019

(65) Prior Publication Data

US 2020/0103118 A1 Apr. 2, 2020

(30) Foreign Application Priority Data

Sep. 11, 2018 (KR) ..... 10-2018-0108353

(51) Int. Cl.
*F23R 3/48* (2006.01)
*F23R 3/44* (2006.01)
*F23R 3/00* (2006.01)

(52) U.S. Cl.
CPC ..... *F23R 3/44* (2013.01); *F23R 3/002* (2013.01); *F23R 3/48* (2013.01)

(58) Field of Classification Search
CPC ..... F23R 3/48; F23R 3/46
See application file for complete search history.

(56) References Cited

U.S. PATENT DOCUMENTS 2,722,803 A * 11/1955 Travers ..... F23R 3/48 60/39.37
2,832,195 A * 4/1958 Weissborn, Jr. ..... F23R 3/48 60/39.37
3,991,560 A * 11/1976 DeCorso ..... F23R 3/48 60/800
5,140,807 A * 8/1992 Shekleton ..... F02C 7/26 60/738
5,603,531 A * 2/1997 Maier ..... F16L 27/026 285/145.1
2004/0098990 A1* 5/2004 Coppola ..... F23R 3/48 60/800
2011/0067406 A1* 3/2011 Widener ..... F23R 3/48 60/754

(Continued)

FOREIGN PATENT DOCUMENTS

JP 2001-003459 A 1/2001
JP 2007-033025 A 2/2007
KR 10-2016-0068682 A 6/2016

*Primary Examiner* — Gerald L Sung

(57) ABSTRACT

A crossfire tube to pass a flame from a combustor chamber of a first combustor to a combustor chamber of a second combustor adjacent to the first combustor is provided. The crossfire tube includes a first insertion pipe configured to connect an inner liner and an outer liner of the first combustor, the inner liner defining the combustion chamber and the outer liner surrounding the inner liner, a second insertion pipe configured to connect an inner liner and an outer liner of a liner of the second combustor, and a connection pipe disposed between the first combustor and the second combustor and connected to the first insertion pipe and the second insertion pipe at respective ends thereof so that the combustion chamber of the first combustor communicates with the combustion chamber of the second combustor via the connection pipe.

9 Claims, 7 Drawing Sheets

(56) References Cited

U.S. PATENT DOCUMENTS

| | | | | |
|---|---|---|---|---|
| 2014/0137536 | A1* | 5/2014 | Cloninger | F23R 3/48<br>60/39.37 |
| 2014/0144122 | A1* | 5/2014 | Overby | F23R 3/48<br>60/39.37 |
| 2015/0204543 | A1* | 7/2015 | Kishida | F23R 3/06<br>60/752 |
| 2016/0298853 | A1 | 10/2016 | Boudin et al. | |
| 2018/0023813 | A1* | 1/2018 | Barton | F23R 3/60<br>60/800 |

* cited by examiner

CROSSFIRE TUBE, COMBUSTOR INCLUDING THE SAME, AND GAS TURBINE INCLUDING THE SAME

CROSS REFERENCE TO RELATED APPLICATION

This application claims priority to Korean Patent Application No. 10-2018-0108353, filed on Sep. 11, 2018, the entire disclosure of which is incorporated herein by reference in its entirety.

BACKGROUND

1. Field

Apparatuses and methods consistent with exemplary embodiments relate to a crossfire tube, combustor, and gas turbine including the same and, more particularly, to a crossfire tube that interconnects combustors to pass an ignition flame from an ignited combustor to another combustor, a combustor that combusts fuel to produce high temperature and high-pressure combustion gas, and a gas turbine including the same.

2. Description of the Related Art

A gas turbine includes a compressor section, a combustor section, and a turbine section. The compressor section includes multiple compressor vanes and multiple compressor blades that are alternately arranged in a compressor casing with an air inlet through which external air is introduced. The introduced air passes through an internal space of the compressor casing, thereby compressing to a target pressure.

The combustor section mixes the compressed air compressed by the compressor section with fuel and ignites a fuel-air mixture with an igniter to produce a high temperature and high-pressure combustion gas which is supplied to the turbine section. To this end, a combustor in the combustor section includes a liner defining a combustion chamber in which fuel is combusted and a transition piece which passes the combustion gas to the turbine section.

The turbine section includes multiple turbine vanes and multiple turbine blades alternately arranged in a turbine casing. The combustion gas produced in the combustor section passes through the turbine section. The combustion gas rotates the turbine blades while moving through the turbine section and exits the turbine section through a diffuser provided at a rear end of the turbine section.

The gas turbine further includes a tie rod. The tie rod extends through centers of compressor disks to which compressor blades are fastened and centers of turbine disks to which turbine blades are fastened. That is, the tie rod ties the compressor disks and the turbine disks not to be freely movable in a gas turbine.

A gas turbine has no reciprocating mechanism such as a piston that is usually provided in a 4-stroke engine. That is, because the gas turbine has no frictional parts such as a piston-cylinder part, the gas turbine has advantages that consumption of lubricating oil is extremely small and an operational stroke which is relatively long in common reciprocating mechanisms is reduced. Therefore, the gas turbine has an advantage of high operation speed, leading to production of a large capacity of electricity.

A gas turbine also includes crossfire tubes between combustors to pass an ignition flame from one combustor (ignited combustor) to another combustor. The crossfire tube is provided at a region corresponding to the liner section of the combustor. That is, each crossfire tube passes a flame generated in the liner section of a combustor to the liner section of another combustor.

In a related art, a crossfire tube is installed in a single-walled liner.

That is, there is a problem that no existing gas turbine has a crossfire tube installed in a double-walled liner.

SUMMARY

Aspects of one or more exemplary embodiments provide a crossfire tube installed in a double-walled liner, a combustor including the crossfire tube, and a gas turbine including the combustor.

Additional aspects will be set forth in part in the description which follows and, in part, will become apparent from the description, or may be learned by practice of the exemplary embodiments.

According to an aspect of an exemplary embodiment, there is provided a crossfire tube for passing a flame from a combustor chamber of a first combustor to a combustor chamber of a second combustor adjacent to the first combustor, the crossfire tube including: a first insertion pipe configured to connect an inner liner and an outer liner of a liner of the first combustor, the inner liner defining the combustion chamber and the outer liner surrounding the inner liner; a second insertion pipe configured to connect an inner liner and an outer liner of a liner of the second combustor; and a connection pipe disposed between the first combustor and the second combustor and connected to the first insertion pipe and the second insertion pipe at respective ends thereof so that the combustion chamber of the first combustor communicates with the combustion chamber of the second combustor via the connection pipe.

The first insertion pipe may extend to pass through the outer liner and the inner liner of the first combustor in a thickness direction to communicate with the combustion chamber of the first combustor.

The first insertion pipe may include an insertion flange protruding from an outer surface of a connection pipe-side end thereof in a radial direction and the connection pipe may include a connection flange protruding from an outer surface of an insertion pipe-side end thereof in a radial direction.

The crossfire tube may further include a coupling ring disposed between the first insertion pipe and the connection pipe to connect the first insertion pipe and the connection pipe.

The coupling ring may be a ring-shaped member and have a circumferential groove formed in an inner surface thereof, the first insertion pipe may include an insertion flange protruding from an outer surface of a connection pipe-side end thereof in a radial direction, the connection pipe may include a connection flange protruding from an outer surface of an insertion pipe-side end thereof in a radial direction, and insertion flange and the connection flange are in contact with each other and are fitted into the circumferential groove.

The inner liner may include an annulus protrusion protruding from an outer surface thereof in a radial direction, and the first insertion pipe may include an annulus insertion groove into which the annulus protrusion is fitted.

The first insertion pipe may include an insertion flange protruding from an outer surface of a connection pipe-side end thereof in a radial direction, the connection pipe may include a connection flange protruding from an outer surface of an insertion pipe-side end thereof in a radial direction, the connection pipe-side end and the insertion pipe-side end facing each other. The outer liner may include an outer flange protruding from an outer surface thereof in a radial direction, in which an end of the outer flange, which is near the insertion flange, is bent outward in the radial direction of the first insertion pipe. The coupling ring may include a circumferential groove into which an insertion flange-side end of the outer liner, the insertion flange, and the connection flange may be fitted.

According to an aspect of another exemplary embodiment, there is provided a combustor including: a nozzle configured to inject fuel; a liner including an inner liner defining a combustion chamber in which the fuel injected from the nozzle is ignited and an outer liner surrounding the inner liner; a transition piece connected to the liner; and a crossfire tube disposed in the liner to pass a flame generated in the combustion chamber to a combustion chamber of an adjacent combustor, wherein the crossfire tube may include an insertion pipe configured to connect the inner liner and the outer liner and a connection pipe connected to an outer end of the insertion pipe and configured to enable the combustion chamber of the combustor to communicate with the combustion chamber of the adjacent combustor.

According to an aspect of another exemplary embodiment, there is provided a gas turbine including: a compressor configured to compress air externally introduced; a combustor configured to mix the compressed air with fuel and to burn the air and fuel mixture; and a turbine configured to pass combustion gas generated by the combustor. The combustor may include a nozzle configured to inject the fuel, a liner including an inner liner defining a combustion chamber in which the fuel injected from the nozzle is ignited and an outer liner surrounding the inner liner, a transition piece connected to the liner, and a crossfire tube disposed in the liner to pass a flame generated in the combustion chamber of the combustor to a combustion chamber of an adjacent combustor, wherein the crossfire tube may include an insertion pipe configured to connect the inner liner and the outer liner and a connection pipe connected to an outer end of the insertion pipe and configured to enable the combustion chamber of the combustor to communicate with the combustion chamber of the adjacent combustor.

According to one or more exemplary embodiments, the crossfire tube may include the insertion pipe connected to the liner including the inner liner and the outer liner and the connection pipe connected between the insertion pipes adjacent to each other, thereby passing a flame between combustors having a double-walled liner.

According to one or more exemplary embodiments, the insertion flange and the connection flange are coupled by the coupling ring. Therefore, the insertion pipe and the connection pipe are securely coupled with each other.

Further, according to one or more exemplary embodiments, the insertion pipe is inserted into the liner, and the insertion pipe and the connection pipe are coupled via the coupling ring. Therefore, it is possible to provide a crossfire tube that can easily pass a flame between combustors and a combustor with a light weight as compared to a related art in which an additional fixing member is used to fix the connection pipe to the liner.

BRIEF DESCRIPTION OF THE DRAWINGS

The above and other aspects will be more apparent from the following description of the exemplary embodiments with reference to the accompanying drawings, in which.

DETAILED DESCRIPTION

Figure 1:
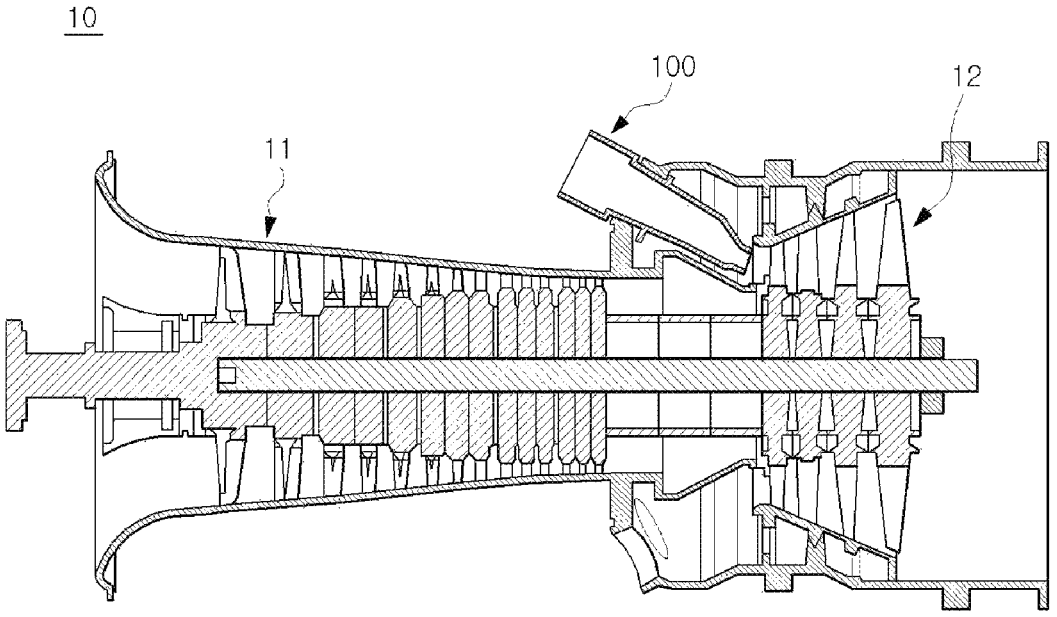
FIG. 1 is a cross-sectional view illustrating a gas turbine according to an exemplary embodiment.

Various modifications may be made to the embodiments of the disclosure, and there may be various types of embodiments. Thus, specific embodiments will be illustrated in drawings, and embodiments will be described in detail in the description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing the embodiments, detailed explanation of related known technologies may unnecessarily confuse the gist of the disclosure, the detailed explanation will be omitted.

Hereinbelow, exemplary embodiments will be described in detail with reference to the accompanying drawings. In order to clearly illustrate the disclosure in the drawings, some of the elements that are not essential to the complete understanding of the disclosure may be omitted, and like reference numerals refer to like elements throughout the specification.

FIG. 1 is a cross-sectional view illustrating a gas turbine according to an exemplary embodiment.

Referring to FIG. 1, a gas turbine 10 includes a compressor section 11, a combustor section 100, and a turbine section 12. Based on a direction of the flow of gas (e.g., compressed gas or combustion gas), the compressor section 11 is disposed at an upstream position, the turbine section 12 is disposed at a downstream position, and the combustor 100 is disposed between the compressor section 11 and the turbine section 12.

The compressor section 11 includes compressor vanes and compressor blades provided in a compressor casing. The turbine section 12 includes turbine vanes and turbine blades provided in a turbine casing. The compressor section 11 includes multiple compression stages arranged in a direction in which combustion gas flows, each stage including multiple compressor vanes and multiple compressor blades. The turbine section 12 includes multiple turbine stages arranged in the direction in which combustion gas flows, each stage including multiple turbine vanes and multiple turbine blades. The compressor section 11 is configured such that an internal diameter decreases with distance toward the last stage, while the turbine section 12 is configured such that an internal diameter increases with distance toward the last stage. Thus, the combustion gas supplied from the combustor section 100 to the turbine section 12 gradually expands while moving toward the last stage in the turbine section 12.

A torque tube for transferring torque generated in the turbine section 12 to the compressor section 11 is disposed between the last-stage rotor of the compressor section 11 and the first-stage rotor of the turbine section 12. FIG. 1 illustrates a case in which the torque tube includes multiple torque tube disks arranged in three stages, but it is understood that this is only an example and other exemplary embodiments are not limited thereto. For example, the torque tube may include multiple torque tube disks arranged in four or more stages or in two or less stages.

Each compressor rotor stage includes a compressor disk and multiple compressor blades fastened to the compressor disk. That is, the compressor section 11 includes multiple compressor disks provided in the compressor casing, and the compressor disks are fastened by the tie rod to prevent axial separation in an axial direction. The compressor disks are arranged in the axial direction with the tie rod extending through the centers of the compressor disks. Adjacent compressor disks are arranged so that opposing surfaces thereof are in tight contact with each other by being tightly fastened by the tie rod. The adjacent compressor disks cannot rotate because of this arrangement. The compressor blades are radially fastened to an outer surface of each of the compressor disks. The compressor vanes radially fastened to an internal surface of the compressor casing are arranged between the compressor blades. While the compressor disks rotate along with a rotation of the tie rod, the compressor vanes fixed to the compressor casing do not rotate. The compressor vanes guide the flow of the compressed air moved from front-stage compressor blades to rear-stage compressor blades. Hereinafter, the compressor casing and the compressor vanes will be collectively referred to as a "compressor stator" so as to be clearly distinguished from the parts of the compressor rotor.

The tie rod is installed to extend through the centers of the multiple compressor disks and the centers of the multiple turbine disks, one end of the tie rod is fixed in the most upstream compressor disk, and the opposite end is fixed in the torque tube by a fixing nut.

It is understood that the type of the tie rod may not be limited to the example illustrated in FIG. 1, and may be changed or vary according to one or more other exemplary embodiments. For example, there are three types of tie rods: a single-type in which a single tie rod extends through the centers of the compressor disks; a multi-type in which multiple tie rods are arranged in a circumferential direction; and a complex type in which the single-type and the multi-type are combined.

Also, a deswirler is installed at the rear end of the compressor section of the gas turbine. The deswirler is a guide vane configured to control an actual inflow angle of fluid entering into an inlet of the combustor section so that the actual inflow angle matches the designed inflow angle.

Figure 2:
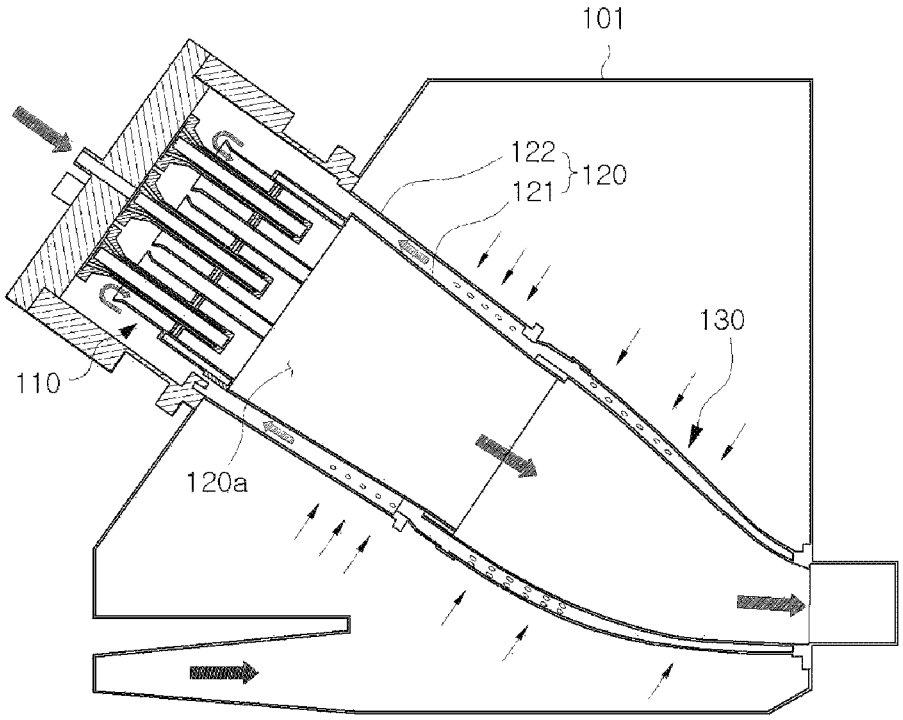
FIG. 2 is a cross-sectional view of a combustor of the gas turbine of FIG. 1.

FIG. 2 is a cross-sectional view of a combustor of the gas turbine of FIG. 1.

Referring to FIG. 2, the combustor 100 mixes the introduced compressed air with fuel, burns the fuel-air mixture to produce a high temperature and high-pressure combustion gas, and increases the temperature of the combustion gas to a temperature at which the combustor and the turbine are able to be resistant to heat through an isobaric combustion process.

A plurality of combustors 100 constituting the gas turbine are arranged in a circumferential direction of the tie rod in a combustor casing 101. Each combustor 100 includes a fuel injection nozzle 110, a liner 120 defining a combustion chamber, and a transition piece 130 serving as a connector between the combustor and the turbine.

The liner 120 provides a combustion space in which the fuel injected through the fuel injection nozzle 110 and the compressed air supplied from the compressor section are mixed and burned. The liner includes a combustion chamber 120*a* having the combustion space in which the fuel mixed with the compressed air is burned and a liner annulus channel surrounding the combustion chamber 120*a*. The liner annulus channel is an annulus space defined by an inner liner 121 serving as a shell of the combustor chamber 120*a* and an outer liner 122 installed to surround the inner liner 121. That is, the liner 120 includes the inner liner 121 and the outer liner 122. The fuel injection nozzle 110 is coupled to a front end of the liner 120, and a spark igniter plug is coupled to a side surface of the liner 120.

An outer wall of the liner 120 is provided with multiple holes through which the compressed air is introduced into the liner annulus channel, and the introduced compressed air cools the liner 120 while flowing toward the transition piece 130. On the other hand, cooling air (i.e., the compressed air) introduced into the transition piece 130 flows toward the annulus channel of the liner 120 after cooling the transition piece 130. Because the compressed air flows along the wall surface of the liner 120, it is possible to prevent the heat of the combustion gas generated in the combustor chamber 120*a* from causing damage to the liner 120.

A rear end of the liner 120 is connected to the transition piece 130 to transfer the combustion gas to the turbine section. The transition piece 130 has an annulus channel surrounding an internal space thereof. The compressed air flows through the annulus channel of the transition piece 130, thereby cooling an outer wall of the transition piece 130 to prevent the transition piece 130 from being damaged by high temperature combustion gas.

The high temperature and high-pressure combustion gas supplied from the combustor 100 flows into the turbine 12 and expands while passing through the turbine 12, thereby applying impacting force or reaction force to the turbine blades to generate torque. A portion of the torque is transmitted to the compressor via the torque tube and a remaining portion of the torque is used to drive an electric generator.

The turbine section 12 is similar to the compressor section 11 in structure. That is, the turbine section 12 includes multiple turbine rotors similar to the compressor rotors, and the turbine rotor includes a turbine disk and multiple turbine blades radially fastened to the turbine disk. For example, multiple turbine vanes fixed to the inner circumferential surface of the turbine casing are alternately arranged with the turbine blades to control a flow direction of the combustion gas passing through the turbine blades. The turbine casing and the turbine vanes are collectively referred to as a turbine stator so as to be distinguished from the parts of the turbine rotor.

Figure 3:
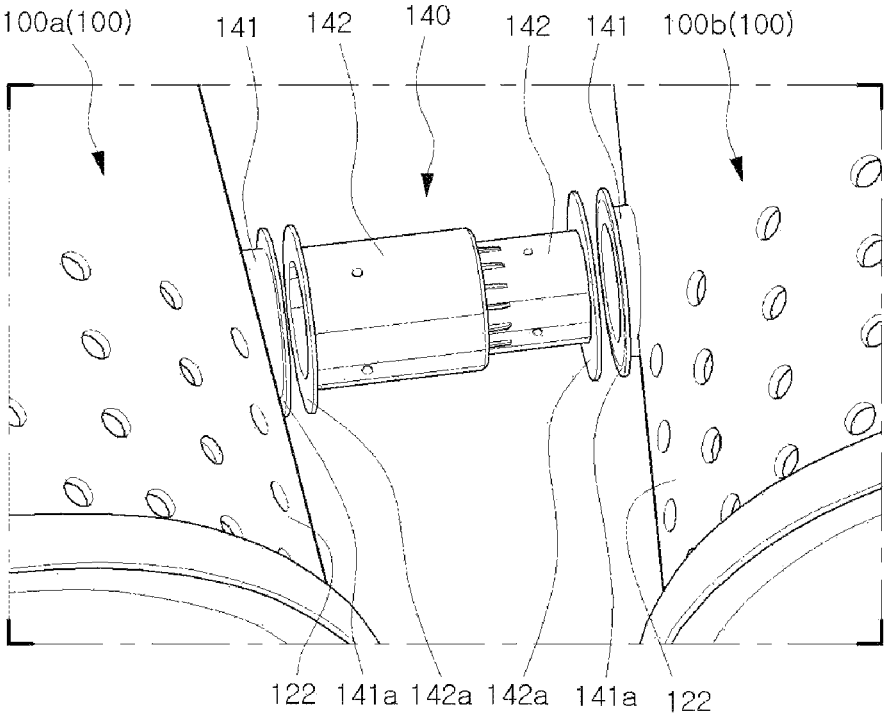
FIG. 3 is a diagram illustrating a crossfire tube installed between combustors according to an exemplary embodiment.
Figure 4:
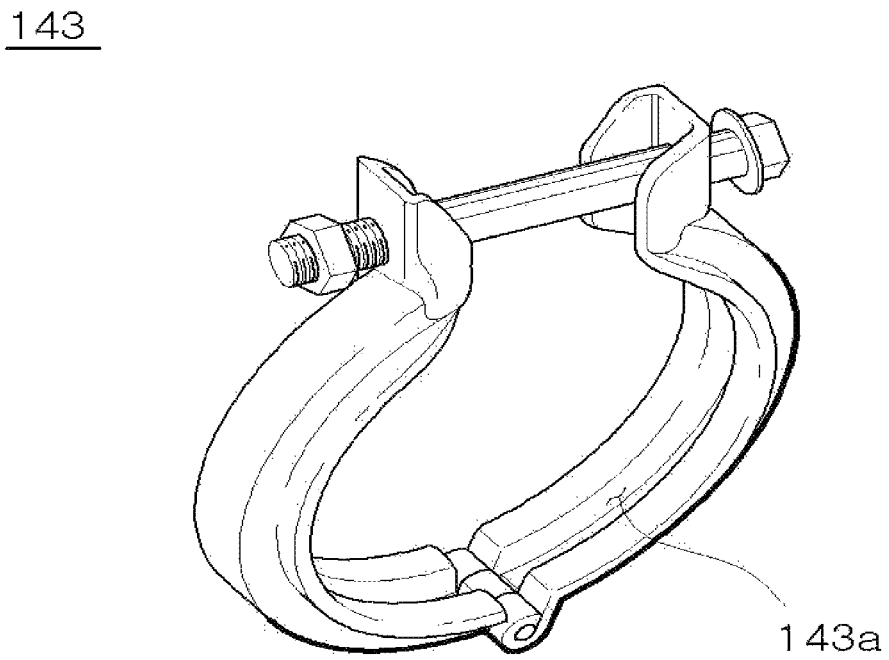
FIG. 4 is a perspective view illustrating a coupling ring included in a combustor according to an exemplary embodiment.
Figure 5:
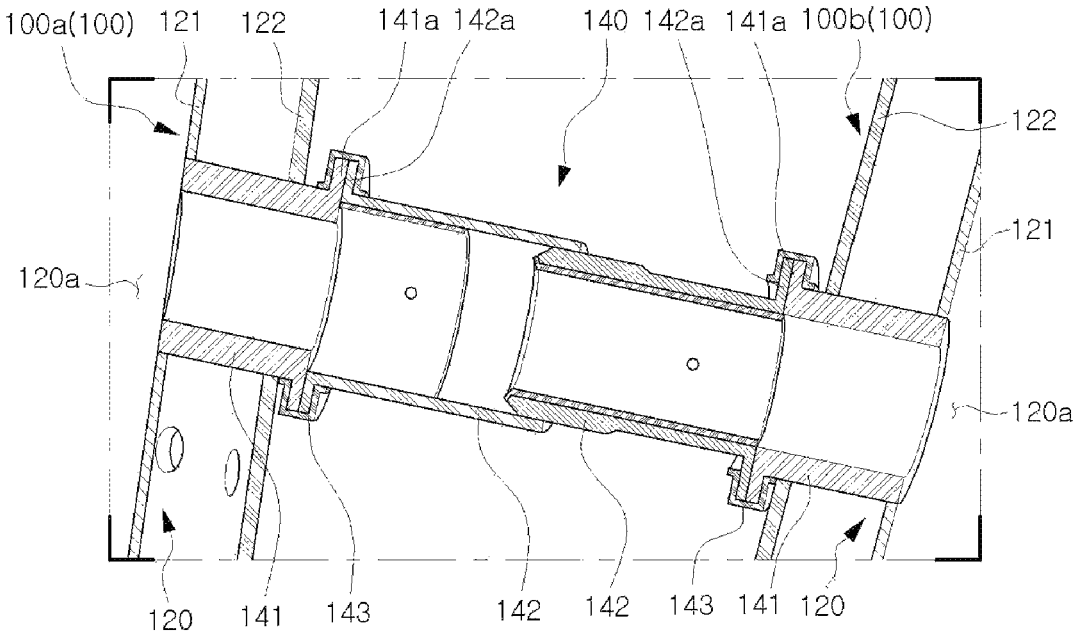
FIG. 5 is a cross-sectional view of a crossfire tube of a gas turbine according to an exemplary embodiment, in which the coupling ring of FIG. 4 is installed between an insertion pipe and a connection pipe.

FIG. 3 is a diagram illustrating a crossfire tube installed between combustors according to an exemplary embodiment. FIG. 4 is a perspective view illustrating a coupling ring included in a combustor according to an exemplary embodiment. FIG. 5 is a cross-sectional view of a crossfire tube of a gas turbine according to an exemplary embodiment, in which the coupling ring of FIG. 4 is installed between an insertion pipe and a connection pipe.

Referring to FIGS. 3 through 5, a crossfire tube 140 is installed between a first combustor 100*a* and a second combustor 100*b* adjacent to each other. The crossfire tube 140 passes a flame generated by the first combustor 100*a* to the second combustor 100*b*. The crossfire tube 140 includes an insertion pipe 141, a connection pipe 142, and a coupling ring 143.

The insertion pipe 141 is a cylindrical pipe and is installed to pass through the outer liner 122 and the inner liner 121 in a thickness direction. A first end of the insertion pipe 141 is connected to an outer wall of the inner liner 121 and a second end of the insertion pipe 141 is provided with an insertion flange 141*a* protruding from an outer surface in a radial direction.

The connection pipe 142 is a cylindrical pipe. A first end of the connection pipe 142 is connected with the second end of the insertion pipe 141 and a second end of the connection pipe 142 is disposed near an adjacent combustor 100. The first end of the connection pipe 142 is provided with a connection flange 142*a* protruding from an outer surface in a radial direction so as to be coupled with the insertion flange 141*a*. The second end of the connection pipe 142 is coupled with a second end of another connection pipe 142 connected with the adjacent combustor 100. In this way, because the connection pipe 142 connected with one combustor is coupled with the connection pipe 142 connected with another combustor, the crossfire tube 140 is provided between the first and second combustors 100*a* and 100*b* in such a manner that one insertion pipe 141, one connection pipe 142, one connection pipe 142, and one insertion pipe 141 are sequentially connected.

That is, one insertion pipe 141 is installed to pass through the outer liner 122 and the inner liner 121 of one combustor in the thickness direction so as to communicate with the combustion chamber 120*a* provided in the inner liner 121 of the combustor, and a pair of connection pipes 142 are provided between the insertion pipes 141 connected to the adjacent combustors. Therefore, a flame generated in the double-walled liner 120 (i.e., the inner liner 121 and the outer liner 122 of one combustor) can be transferred to the liner 120 of another combustor.

Referring to FIG. 4, the coupling ring 143 is a ring-shaped member and is installed between the insertion pipe 141 and the connection pipe 142 to couple the insertion pipe 141 and the connection pipe 142 with each other. To this end, the coupling ring 143 has a circumferential groove 143*a* formed in an inner surface thereof.

When the insertion flange 141*a* is contact to the connection flange 142*a*, the coupling ring 143 surrounds the insertion flange 141*a* and the connection flange 142*a* such that the insertion flange 141*a* and the connection flange 142*a* are fitted into a circumferential groove 143*a*. The coupling ring 143 is tightened such that a diameter of the coupling ring 143 is reduced. Thus, the insertion flange 141*a* and the connection flange 142*a* are tightened. Therefore, the insertion pipe 141 and the connection pipe 142 are securely coupled by the coupling ring 143.

According to the exemplary embodiment, the insertion pipe 141 connects the inner liner 121 and the outer liner 122 of the liner 120 of the combustor and a pair of connection pipes connects two insertion pipes 141 respectively connected to the adjacent combustors (i.e., the first and second combustors 100*a* and 100*b*). Therefore, the exemplary embodiment has an advantage of being capable of passing a flame between the adjacent first and second combustors 100*a* and 100*b* which have double-walled liner structure.

In addition, the insertion pipe 141 and the connection pipe 142 are coupled with each other by fastening the insertion flange 141*a* and the connection flange 142*a* with the coupling ring 143. Therefore, the insertion pipe 141 and the connection pipe 142 are securely coupled with each other.

In the related art crossfire tube, an additional fixing member is used to connect the connection pipe 142 to the liner 120. In a related art gas turbine using the additional fixing member, because the fixing member for fixing the connection pipe 142 to the liner 120 of the combustor is very heavy, the overall weight of the combustor is increased and a space for accommodating the additional fixing member is required.

However, according to the exemplary embodiment, an additional fixing member for connection between the connection pipe 142 and the liner 120 is not required because the insertion pipe 141 is installed to pass through the liner 120 and the coupling ring 143 is used to couple the insertion pipe 141 and the connection pipe 142. That is, it is possible to install the crossfire tube 140 between the first combustor 100*a* and the second combustor 100*b* without using an additional fixing member. Therefore, the overall weight of the combustor 100 is reduced and the crossfire tube 140 can be easily coupled to the liner 120.

Figure 6:
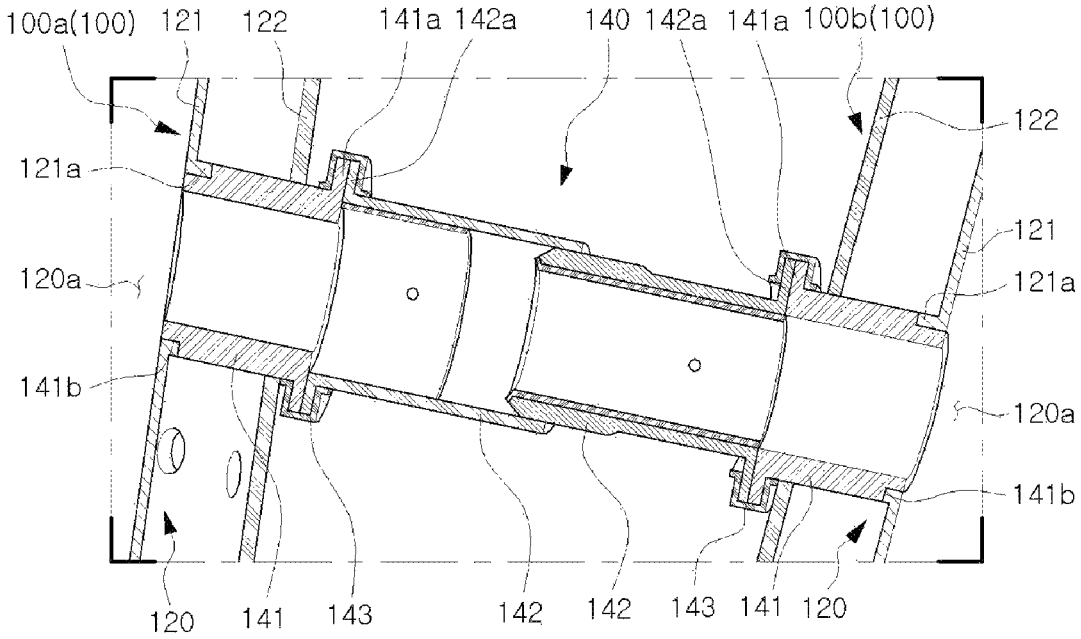
FIG. 6 is a cross-sectional view of a crossfire tube of a gas turbine according to another exemplary embodiment.

FIG. 6 is a cross-sectional view of a crossfire tube of a gas turbine according to another exemplary embodiment.

Referring to FIG. 6, an inner liner 121 has an annulus protrusion 121*a* protruding from an outer surface of the inner liner 121 in a radial direction. An insertion pipe 141 has an annulus insertion groove 141*b* into which the annulus protrusion 121*a* is fitted.

Therefore, the inner liner 121 and the insertion pipe 141 are securely coupled by the annulus protrusion 121*a* fitted into the annulus insertion groove 141*b*, thereby preventing a flame transferred from a combustion chamber 120*a* to the insertion pipe 141 from leaking through a gap between the inner liner 121 and the insertion pipe 141.

Figure 7:
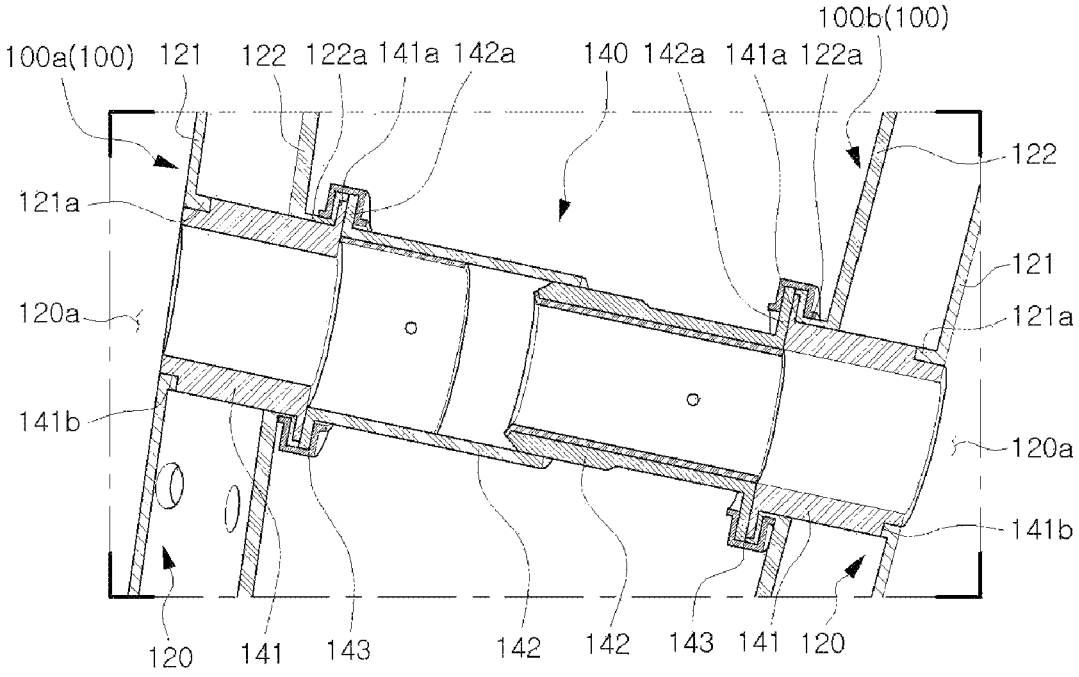
FIG. 7 is a cross-sectional view of a crossfire tube of a gas turbine according to another exemplary embodiment.

FIG. 7 is a cross-sectional view of a crossfire tube of a gas turbine according to another exemplary embodiment.

Referring to FIG. 7, an outer liner 122 has an outer flange 122*a* protruding from an outer surface thereof in a radial direction. The outer flange 122*a* is bent to protrude outward in a radial direction of an insertion pipe 141 at an end of the outer flange 122*a*, which is near an insertion flange 141*a*.

One surface of the insertion flange 141*a* is in contact with an end of the outer flange 122*a*, and the other surface of the insertion flange 141*a* is in contact with a connection flange 142*a*. In this state, an end of the outer flange 122*a*, which is near the insertion flange 141*a*, the insertion flange 141*a*, and the connection flange 142*a* are fitted into the circumferential groove 143*a* formed in an inner surface of the coupling ring 143.

The coupling ring 143 is tightened in a state in which the outer flange 122*a*, the insertion flange 141*a*, and the connection flange 142*a* are fitted into the circumferential groove 143*a*. Therefore, the insertion pipe 141 and the connection pipe 142 are securely coupled to each other, and the insertion pipe 141 and the connection pipe 142 are securely coupled to the outer liner 122.

Therefore, the exemplary embodiment has advantages that the crossfire tube 140 can be securely coupled to the liner 120 and compressed air that flows between the inner liner 121 and the outer liner 122 is not likely to leak through a gap between the outer liner 122 and the insertion pipe 141.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A crossfire tube for passing a flame from a combustor chamber of a first combustor to a combustor chamber of a second combustor adjacent to the first combustor, the crossfire tube comprising:

a first insertion pipe configured to connect an inner liner and an outer liner of a liner of the first combustor, the inner liner defining the combustor chamber and the outer liner surrounding the inner liner;

a second insertion pipe configured to connect an inner liner and an outer liner of a liner of the second combustor;

a connection pipe disposed between the first combustor and the second combustor and connected to the first insertion pipe and the second insertion pipe at respective ends thereof so that the combustion chamber of the first combustor communicates with the combustion chamber of the second combustor via the connection pipe; and a coupling ring disposed between the first insertion pipe and the connection pipe to connect the first insertion pipe and the connection pipe, wherein the first insertion pipe includes an insertion flange protruding from an outer surface of a connection pipe-side end thereof in a radial direction, the connection pipe includes a connection flange protruding from an outer surface of an insertion pipe-side end thereof in the radial direction, the connection pipe-side end and the insertion pipe-side end facing each other, the outer liner includes an outer flange protruding from an outer surface thereof in the radial direction, in which an end of the outer flange, which is near the insertion flange, is bent outward in the radial direction of the first insertion pipe, and the coupling ring includes a circumferential groove into which the end of the outer flange, the insertion flange, and the connection flange are fitted.

2. The crossfire tube according to claim 1, wherein the first insertion pipe extends to pass through the outer liner and the inner liner of the first combustor in a thickness direction to communicate with the combustor chamber of the first combustor.

3. The crossfire tube according to claim 2, wherein the inner liner includes an annulus protrusion protruding from an outer surface thereof, and the first insertion pipe includes an annulus insertion groove into which the annulus protrusion is fitted.

4. A combustor comprising:

a nozzle configured to inject fuel;

a liner including an inner liner defining a combustion chamber in which the fuel injected from the nozzle is ignited and an outer liner surrounding the inner liner;

a transition piece connected to the liner; and a crossfire tube disposed in the liner to pass a flame generated in the combustion chamber to a combustion chamber of an adjacent combustor, wherein the crossfire tube includes an insertion pipe configured to connect the inner liner and the outer liner and a connection pipe connected to an outer end of the insertion pipe and configured to enable the combustion chamber of the combustor to communicate with the combustion chamber of the adjacent combustor, and a coupling ring disposed between the insertion pipe and the connection pipe to connect the insertion pipe and the connection pipe, wherein the insertion pipe includes an insertion flange protruding from an outer surface of a connection pipe-side end thereof in a radial direction, the connection pipe includes a connection flange protruding from an outer surface of an insertion pipe-side end thereof in the radial direction, the outer liner includes an outer flange protruding from an outer surface thereof in the radial direction, in whish an end of the outer flange, which is near the insertion flange, is bent outward in the radial direction, and the coupling ring includes a circumferential groove into which the end of the outer flange, the insertion flange, and the connection flange are fitted.

5. The combustor according to claim 4, wherein the insertion pipe is installed to pass through the outer liner and the inner liner in a thickness direction to communicate with the combustion chamber of the combustor.

6. The combustor according to claim 5, wherein the inner liner includes an annulus protrusion protruding from an outer surface, and the insertion pipe includes an annulus insertion groove into which the annulus protrusion is fitted.

7. A gas turbine comprising:

a compressor configured to compress air externally introduced;

a combustor configured to mix the compressed air with fuel and to burn the air and fuel mixture; and a turbine configured to pass combustion gas generated by the combustor, wherein the combustor comprises:

a nozzle configured to inject the fuel;

a liner including an inner liner defining a combustion chamber in which the fuel injected from the nozzle is ignited and an outer liner surrounding the inner liner;

a transition piece connected to the liner; and a crossfire tube disposed in the liner to pass a flame generated in the combustion chamber of the combustor to a combustion chamber of an adjacent combustor, and wherein the crossfire tube includes an insertion pipe configured to connect the inner liner and the outer liner and a connection pipe connected to an outer end of the insertion pipe and configured to enable the combustion chamber of the combustor to communicate with the combustion chamber of the adjacent combustor, and a coupling ring disposed between the insertion pipe and the connection pipe to connect the insertion pipe and the connection pipe, wherein the coupling ring has a circumferential groove formed in an inner surface thereof, and wherein the insertion pipe includes an insertion flange protruding from an outer surface of a connection pipe-side end thereof in a radial direction, the connection pipe includes a connection flange protruding from an outer surface of an insertion pipe-side end thereof in the radial direction, the outer liner includes an outer flange protruding from an outer surface thereof in the radial direction, in which an end of the outer flange, which is near the insertion flange, is bent outward in the radial direction, and, the coupling ring includes a circumferential groove into which the end of the outer flange, the insertion flange and the connection flange are fitted.

8. The gas turbine according to claim 7, wherein the insertion pipe is inserted into the liner from an outside to pass through the outer liner and the inner liner in a thickness direction to communicate with the combustion chamber of the combustor.

9. The gas turbine according to claim 8, wherein the inner liner includes an annulus protrusion protruding from an outer surface thereof, and the insertion pipe includes an annulus insertion groove into which the annulus protrusion is fitted, the annulus insertion groove being formed on an outer surface of an inner liner-side end of the insertion pipe.

* * * * *